US007781659B2

(12) United States Patent
Liao

(10) Patent No.: US 7,781,659 B2
(45) Date of Patent: Aug. 24, 2010

(54) ADJUSTABLE MODULAR DRUM

(76) Inventor: Tsun-Chi Liao, 1F, No. 7, Lane 545, Sec. 2, Jyungong Rd., Beitun Dist., Taichung City (TW)

( * ) Notice: Subject to any disclaimer, the term of this patent is extended or adjusted under 35 U.S.C. 154(b) by 0 days.

(21) Appl. No.: 12/276,345

(22) Filed: Nov. 23, 2008

(65) Prior Publication Data

US 2010/0126330 A1 May 27, 2010

(51) Int. Cl.
*G10D 13/02* (2006.01)

(52) U.S. Cl. ..... 84/412; 84/411 R; 84/413

(58) Field of Classification Search ..... 84/412, 84/411 R, 413
See application file for complete search history.

(56) References Cited

U.S. PATENT DOCUMENTS

| | | | | | |
|---|---|---|---|---|---|
| 274,900 | A * | 4/1883 | Boulanger | 84/411 R |
| 1,420,233 | A * | 6/1922 | Baldwin et al. | 84/411 R |
| 1,768,438 | A * | 6/1930 | Israel | 84/412 |
| 2,546,452 | A * | 3/1951 | Kmieliauskas | 84/412 |
| 2,563,346 | A * | 8/1951 | Livingston | 84/412 |
| 3,865,003 | A * | 2/1975 | Della-Porta | 84/411 R |
| 3,911,779 | A * | 10/1975 | Della-Porta | 84/411 R |
| 4,060,019 | A * | 11/1977 | Cordes | 84/411 R |
| 4,300,437 | A * | 11/1981 | Hinger et al. | 84/411 R |
| 4,334,458 | A * | 6/1982 | Grauso | 84/411 R |
| 4,455,913 | A * | 6/1984 | Willis | 84/412 |
| D296,905 | S * | 7/1988 | Donnelli | D17/22 |
| 5,377,576 | A * | 1/1995 | Good et al. | 84/411 R |
| 5,981,858 | A * | 11/1999 | Jeng | 84/411 R |
| 6,211,448 | B1 * | 4/2001 | Shigenaga et al. | 84/411 R |
| 6,462,262 | B2 * | 10/2002 | Hagiwara | 84/411 R |
| 6,525,250 | B2 * | 2/2003 | Goods | 84/411 R |
| 2009/0308225 | A1 * | 12/2009 | Natali | 84/411 R |
| 2009/0308226 | A1 * | 12/2009 | Paterson | 84/412 |

* cited by examiner

*Primary Examiner*—Jeffrey Donels
*Assistant Examiner*—Robert W Horn
(74) *Attorney, Agent, or Firm*—Muncy, Geissler, Olds & Lowe, PLLC

(57) ABSTRACT

The present invention is related to an adjustable modular drum including a first shell and plural second shells. The first shell has several lugs placed around the outer circumference, and each lug has a screw hole. Moreover, the second shells can be superimposed on the first shell. Furthermore, the drumhead on the first shell can be unloaded and then re-assembled on one of the second shells by a hoop. Then, plural tension rods are passed through the through holes around the outer circumference of the hoop and locked in the screw holes of the lugs for fixing. Accordingly, the height of the drum can be adjusted for conforming to different needs of the user without possessing multiple drums of different standards at the same time, thereby achieving the purposes of carrying convenience and reduced cost.

6 Claims, 5 Drawing Sheets

ADJUSTABLE MODULAR DRUM

FIELD OF THE INVENTION

The present invention is related to a drum, and more particularly to a drum whose height can be adjusted to be low, medium or high for respectively generating sounds at low, medium or high audio frequency.

BACKGROUND OF THE INVENTION

Generally, a snare drum as shown in FIG. 1 can generate sounds at different audio frequencies according to different heights thereof. For the snare drum with identical radial surface area, the higher the height of the drum, the lower the frequency of the sound. Therefore, for generating music with different audio frequencies, the drummer always has to simultaneously own multiple drums, which not only occupies space, but also costs a lot.

SUMMARY OF THE INVENTION

The object of the present invention is to provide an adjustable modular drum whose height can be adjusted to be low or high, so as to generate different audio frequencies, thereby providing carrying convenience and saving storage space.

For achieving the object described above, the present invention provides an adjustable modular drum including:

a first shell, which is a hollow cylinder with a first end and a second end, wherein the first shell has several lugs placed around the outer circumference equidistantly, and each lug has a screw hole at one end thereof;

plural second shells of different heights, each of which has a ring shape with a first end and a second end, and the first end is superimposed on the second end of the first shell;

two drumheads, respectively hooped on the first end of the first shell and the second ends of the second shells;

a hoop of ring shape, surrounding the outer circumference of one of the second shells for tightly hooping the drumhead at the second end of one of the second shells, and having plural through holes mounted around the outer circumference thereof; and plural tension rods of different lengths, which respectively correspond to the heights of the second shells superimposed on the first shell and are passed through the through holes of the hoop on one of the second shells and locked in the screw holes of the lugs.

Thereby, according to different demands on low, medium or high audio frequency, the second shells of different heights can be selected to assemble with the first shell. When assembling, the hoop and the drumhead at the top of the first shell are unloaded and then reloaded at the top of the selected second shell through the tension rods, so as to increase the total height of the drum. Thus, the need to carry multiple snare drums in different standards, and also the cost both can be reduced.

The present invention is advantageous that:

Since the user can generate different audio frequencies by selecting different second shells of different heights to superimpose on the first shell so as to increase the total height of the drum, the demand on possessing multiple snare drums at the same time can be omitted, thereby achieving the purposes of carrying convenience and reduced cost.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
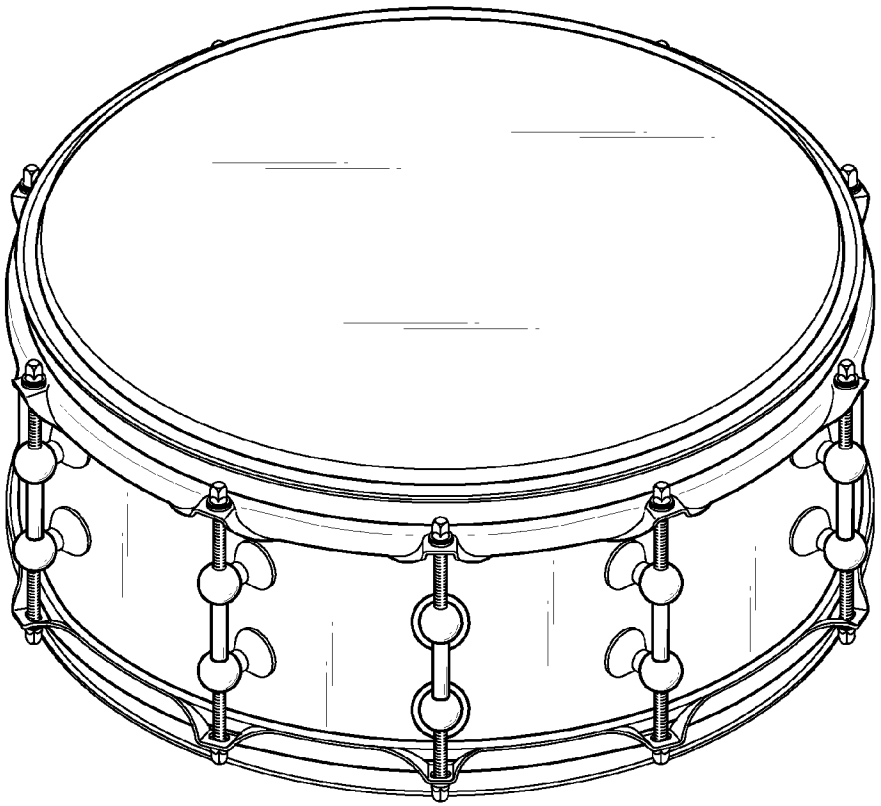
PRIOR ART Fig. 1
FIG. 1 is a drawing showing the appearance of a conventional snare drum.
Figure 2:
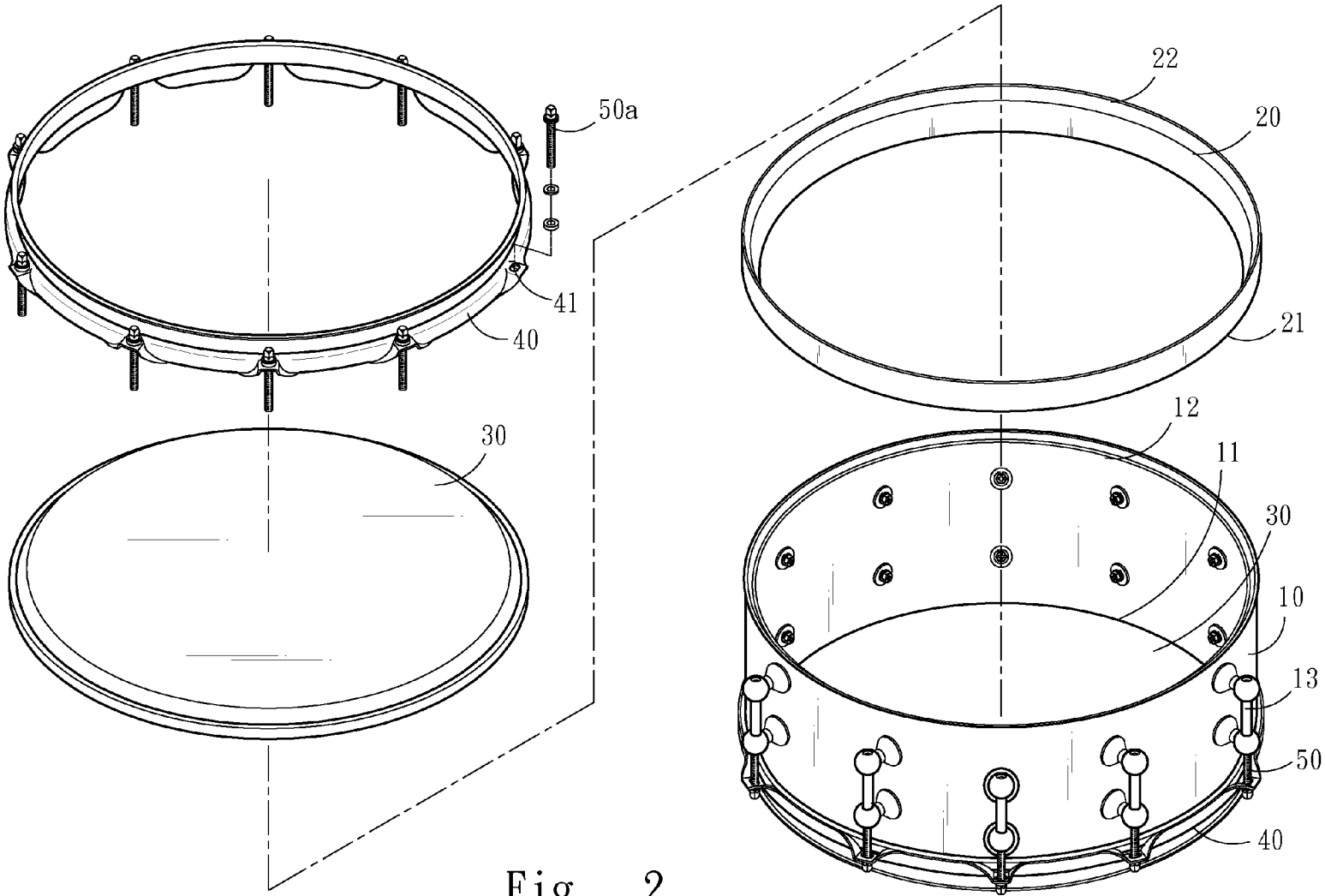
FIG. 2 is a decomposition view showing the present invention in a first embodiment.
Figure 3:
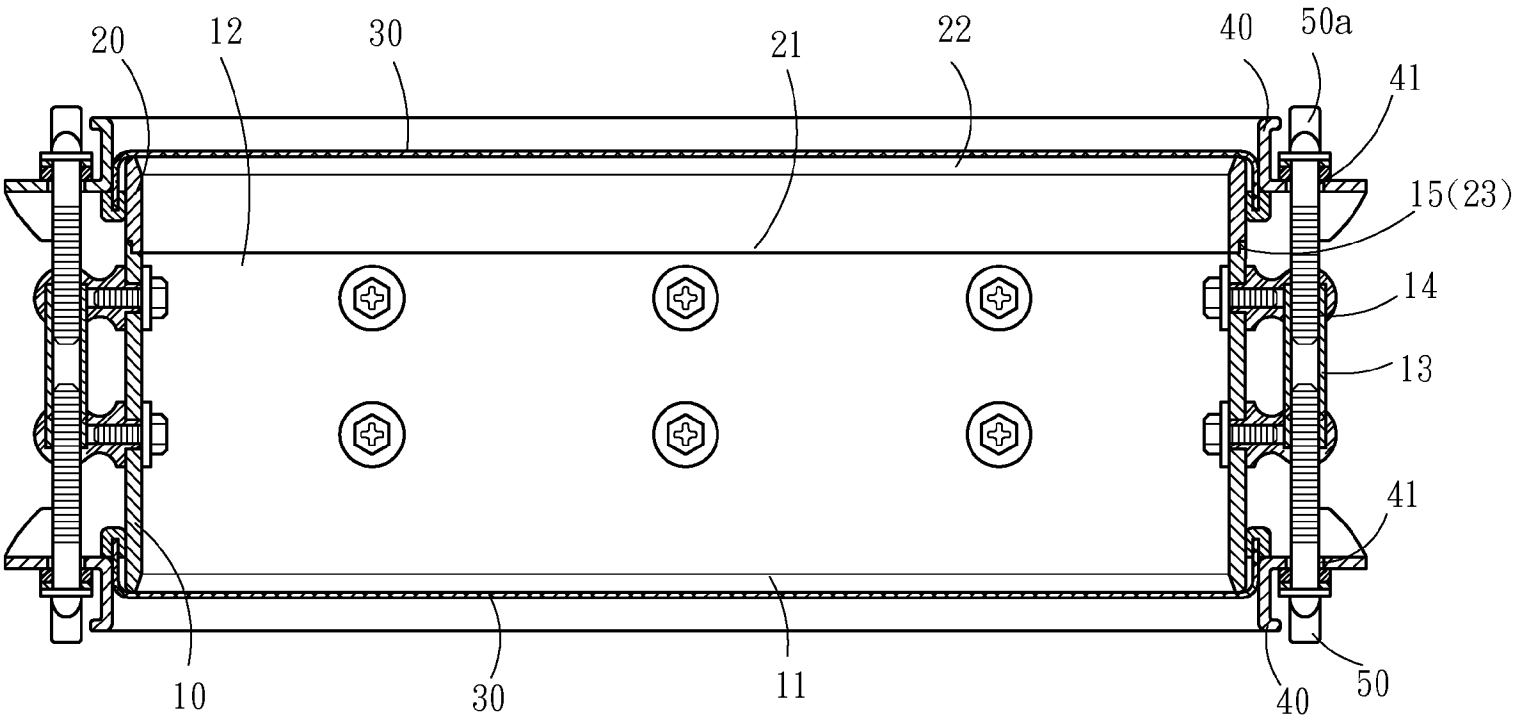
FIG. 3 is a sectional view showing the combination of the present invention in a first embodiment.

Please refer to FIG. 2 and FIG. 3 which are respectively a decomposition view and a sectional view showing the adjustable modular drum according to the first embodiment of the present invention. The adjustable modular drum includes a first shell 10, a second shell 20, two drumheads 30, two hoops 40 and plural tension rods 50, 50*a* of different lengths.

The first shell 10 is a hollow cylinder with a first end 11 and a second end 12. The first shell 10 has several lugs 13 placed around the outer circumference of the first shell 10, wherein each lug 13 is a column with two lateral extensions respectively located at the upper end and the lower end thereof for fixedly connecting with the first shell 10, and the upper and the lower ends of each lug 13 both have a screw hole 14, and the second end 12 has an engaging groove 15 circumferentially mounted at the top thereof.

The second shell 20 has a ring shape with a first end 21 and a second end 22. Here, the second shell 20 has the smallest height as compared with other embodiments. The first end 21 is superimposed on the second end 12 of the first shell 10, and the first end 21 has a protruded collar 23 for engaging with the engaging grove 15.

Two drumheads 30 are respectively hooped on the first end 11 of the first shell 10 and the second end 22 of the second shell 20.

Two hoops 40 are made of metal in a ring shape. One hoop surrounds the outer circumference of the first shell 10 and the other surrounds the outer circumference of the second shell 20 for respectively hooping the drumheads 30 at the first end 11 of the first shell 10 and the second end 22 of the second shell 20. Besides, each hoop 40 has plural through holes 40 mounted around the outer circumference thereof.

In plural tension rods 50, 50*a* of different lengths, the tension rods 50 having shorter length are passed through, from down to up, the through holes 41 around the outer circumference of the hoop 40 on the first shell 10 and locked in the screw holes 14 at the lower ends of the lugs 13, and the longer tension rods 50*a* respectively have a length corresponding to the height of the second shell 20 superimposed on the first shell 10 and are passed through, from up to down, the through holes 41 around the outer circumference of the hoop 40 on the second shell 20 and locked in the screw holes 14 at the upper ends of the lugs 13.

Figure 4:
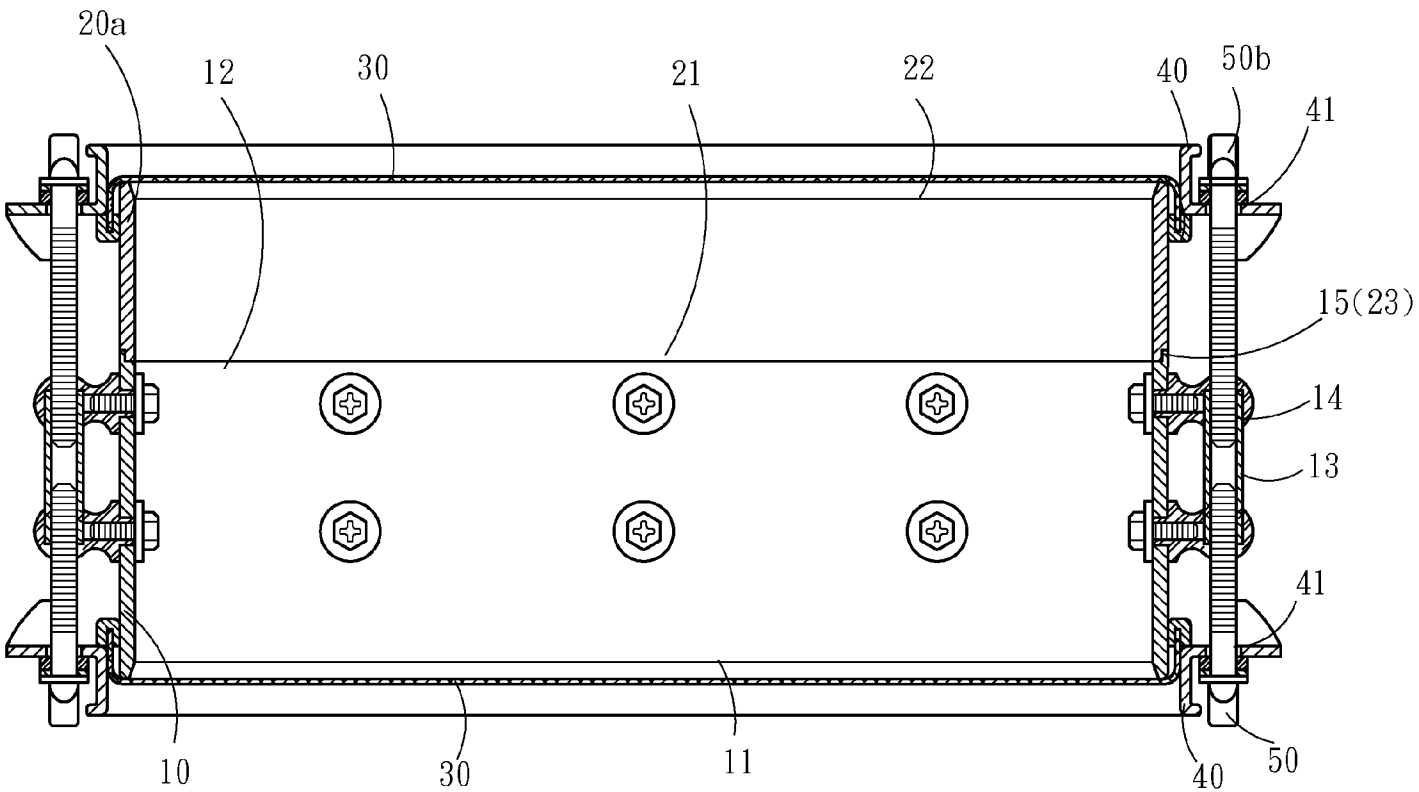
FIG. 4 is a sectional view showing the combination of the present invention in a second embodiment.

Please further refer to FIG. 4 which shows the sectional view of the present invention in an assembled state according to a second embodiment. The second shell 20*a* has a height twice the second shell 20 described above and a shape identical to the second shell 20. Here, the tension rods 50*b* for passing through the through holes 41 around the outer circumference of the hoop 40 on the second shell 20*a* have a length corresponding to the total height of the second shell

20*a* superimposing on the first shell 10 for screwing in the screw hole 14 at the upper end of the lugs 13.

Figure 5:
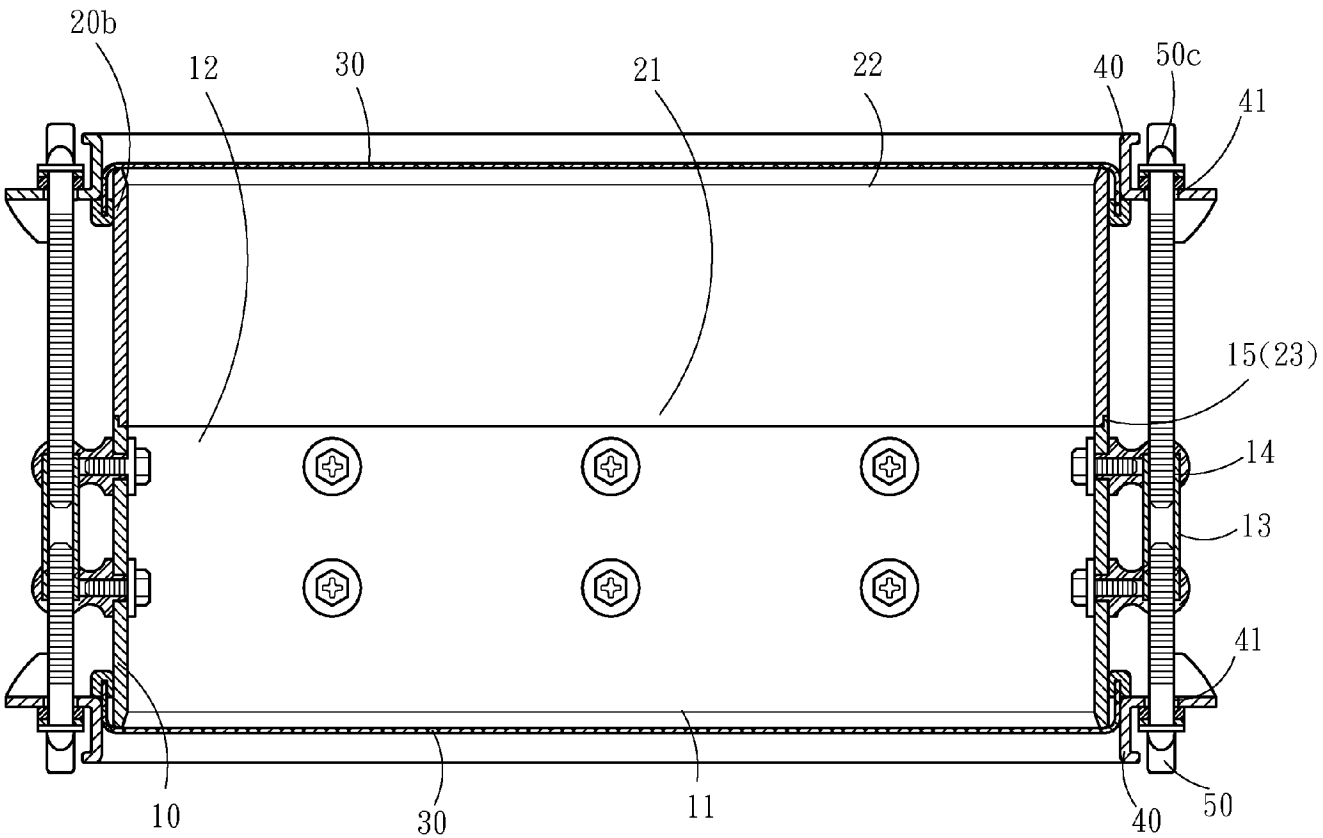
FIG. 5 is a sectional view showing the combination of the present invention in a third embodiment.

FIG. 5 shows the sectional view of the present invention in an assembled state according to a third embodiment. The second shell 20*b* has a height triple the second shell 20 described above and a shape identical to the second shell 20. Here, the tension rods 50*c* for passing through the through holes 41 around the outer circumference of the hoop 40 on the second shell 20*b* have a length corresponding to the total height of the second shell 20*b* superimposing on the first shell 10 for screwing in the screw hole 14 at the upper end of the lugs 13.

Through the structure described above, according to different demands on low, medium or high audio frequencies, second shells 20, 20*a*, 20*b* of different heights can be selected to assemble with the first shell 10. For example, if it is selected to assemble the second shell 20 having the smallest height, as shown in FIG. 2 and FIG. 3, then a higher audio frequency will be generated. When assembling, first, the tension rods 50 of the first shell 10 are removed for unloading the hoop 40 around the first shell 10 and the drumhead 30. Then, the second shell 20 is superimposed on the first shell 10 by the protruded collar 23 at the first end 21 of the second shell 20 tightly engaging with the engaging groove 15 at the second end 12 of the first shell 10. Then, the previously unloaded drumhead 30 is re-assembled on the second end 22 of the second shell 20 and is fixed by the hoop 40 mounting around the outer circumference of the second shell 20. Continuously, the longer tension rods 50*a* are passed through, from up to down, the through holes 41 around the outer circumference of the hoop 40 on the second shell 20 and locked in the screw holes 14 at the upper end of the lugs 13, thereby tightly stretching and fixing the drumhead 30.

If the user needs to generate a sound at medium audio frequency, the second shell 20*a* with medium height, as shown in FIG. 4, can be selected to superimpose on the first shell 10, so as to change the audio frequency through enlarging the inner space of the drum. As to the assembling steps, they are identical to the description above and are omitted.

FIG. 5 shows the choice of the second shell 20*b*, which has an even larger size in height, so that when the second shell 20*b* is superimposed on the first shell 10, the total height can be further increased, thereby achieving a lower audio frequency.

In the aforesaid, the present invention is advantageous that:

Because the second shells 20, 20*a*, 20*b* of the present invention have different sizes in height, the user can generate different audio frequencies by selecting different second shells 20, 20*a*, 20*b* to superimpose on the first shell 10 and increase the total height of the drum. Therefore, this not only can save the cost for buying multiple snare drums in different standards, but also can achieve the purpose of convenient carrying.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable modular drum, comprising:

a first shell, which is a hollow cylinder with a first end and a second end, wherein the first shell has several lugs placed around the outer circumference, and each lug has a screw hole at one end thereof;

plural second shells of different heights, each of which has a ring shape with a first end and a second end, and the first end is superimposed on the second end of the first shell;

two drumheads, respectively hooped on the first end of the first shell and the second ends of the second shells;

a hoop, surrounding the outer circumference of one of the second shells for tightly hooping the drumhead of one of the second shells, and having plural through holes mounted around the outer circumference thereof; and plural tension rods of different lengths, which respectively correspond to the heights of the second shells superimposed on the first shell and are passed through the through holes around the outer circumference of the hoop on one of the second shells and locked in the screw holes of the lugs.

2. The adjustable modular drum as claimed in claim 1, wherein the upper end and the lower end of each lug respectively have the screw hole, the number of the hoops is two for respectively hooping the outer circumferences of the first shell and one of the second shells so as to fix two drumheads on the first shell and one of the second shells, the through holes around the outer circumference of the hoop on the first shell are passed through, from down to up, by other tension rods, which are locked in the screw holes at the lower ends of the lugs, and the tension rods are passed through, from up to down, the through holes around the outer circumference of the hoop on one of the second shells and locked in the screw holes at the upper ends of the lugs.

3. The adjustable modular drum as claimed in claim 1, wherein the second end of the first shell has an engaging groove circumferentially mounted at the top thereof, and the first end of one of the second shells has a protruded collar for engaging with the engaging grove.

4. The adjustable modular drum as claimed in claim 1, wherein the heights of plural second shells are mutually multiples.

5. The adjustable modular drum as claimed in claim 1, wherein the hoop is made of metal.

6. The adjustable modular drum as claimed in claim 1, wherein each lug is a column with two lateral extensions respectively located at the upper end and the lower end thereof for fixedly connecting with the first shell.

* * * * *